US009937515B2

(12) United States Patent
Feygelman et al.

(10) Patent No.: US 9,937,515 B2
(45) Date of Patent: Apr. 10, 2018

(54) FLUID APPLICATION

(71) Applicant: Hewlett-Packard Indigo B.V., Amstelveen (NL)

(72) Inventors: Alex Feygelman, Petach-Tiqwa (IL); Mordechai Arenson, Nes Ziona (IL); Ziv Yosef, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/301,134

(22) PCT Filed: Apr. 4, 2014

(86) PCT No.: PCT/EP2014/056807
§ 371 (c)(1),
(2) Date: Sep. 30, 2016

(87) PCT Pub. No.: WO2015/149864
PCT Pub. Date: Oct. 8, 2015

(65) Prior Publication Data

US 2017/0036235 A1 Feb. 9, 2017

(51) Int. Cl.

| | |
|---|---|
| ***B41J 2/17*** | (2006.01) |
| ***B41J 2/01*** | (2006.01) |
| ***B05C 5/02*** | (2006.01) |

(52) U.S. Cl.
CPC ..... *B05C 5/0266* (2013.01)

(58) Field of Classification Search
CPC ..... B05C 5/0266; B41J 2/0057; B41J 2/175; B41J 29/02; B41J 2002/012
USPC ..... 347/84, 85, 103
See application file for complete search history.

(56) References Cited

U.S. PATENT DOCUMENTS

2009/0266256 A1* 10/2009 Rothlein ..... B41F 31/027 101/366
2013/0327269 A1* 12/2013 Suhara ..... B05C 5/0258 118/323

FOREIGN PATENT DOCUMENTS

| | | |
|---|---|---|
| DE | 10253410 | 1/2004 |
| DE | 202009014160 | 12/2009 |
| EP | 0436893 | 7/1991 |
| EP | 0577539 | 1/1994 |
| EP | 2650054 | 10/2013 |
| GB | 1503511 | 3/1978 |
| WO | 2011083518 | 7/2011 |

* cited by examiner

*Primary Examiner* — Jannelle M Lebron
(74) *Attorney, Agent, or Firm* — HP Inc. Patent Department

(57) ABSTRACT

Certain examples of an apparatus, a printing system and a method are described that may be used for applying a fluid. In certain cases, an apparatus has a chamber arranged to receive fluid, the chamber being sealed at one or more ends by one or more respective end seals. In one case, at least one end seal is moveable along an axis of the chamber to adjust at least a volume of the chamber.

20 Claims, 6 Drawing Sheets

FLUID APPLICATION

BACKGROUND

Some printing technologies require special substrate coating or priming treatment prior to the application of ink or toner. Generally this kind of treatment is performed at a stage when a print medium or substrate is fed from a roll, e.g. before cutting operations. Applying a priming treatment in this manner helps the treatment process to be stable and continuous. However, there are cases when a priming treatment needs to be applied to cut sheets of print media or substrate. For example, this may be the case for thick substrates or for cases where a priming fluid needs to be applied shortly before ink application for better ink adhesion. There are also cases where a print medium or substrate may vary in shape and/or size. For example, in a printing system with a variable cut sheet size a substrate coating may need to be applied to varying sizes of sheet.

BRIEF DESCRIPTION OF THE DRAWINGS

Various features and advantages of the present disclosure will be apparent from the detailed description which follows, taken in conjunction with the accompanying drawings, which together illustrate, by way of example only, features of the present disclosure, and wherein.

DETAILED DESCRIPTION

Certain examples as described herein provide an apparatus and method for use in a printing system. In particular, certain examples enable the application of a printing fluid to substrates of varying sizes. In one case, an apparatus is provided that enables a fluid to be applied to substrates of varying widths. In this case, an aperture or slit of the apparatus has an adjustable width, wherein a fluid may be applied to a substrate, e.g. by way of a transfer member, using the aperture. In one case, the aperture is provided in a closed or pressurized chamber, wherein one or more of a number of lateral end seals of the chamber are moveable to adjust the width of the aperture.

In certain examples described herein a chamber of the apparatus is mountable such that an aperture or slit of the apparatus is a defined distance from a transfer medium. In this case, the apparatus does not contact the transfer medium, enabling movement of the transfer medium to accommodate different substrate sizes. For example, this arrangement of the apparatus and the transfer medium enables the transfer medium to be moved upwards and downwards in relation to the apparatus, e.g. in certain cases while maintaining the defined distance. This movement of the transfer medium allows the accommodation of different substrate length. With certain described examples, such adjustments are also possible with a minimal amount of down time and/or operator intervention.

Figure 1:
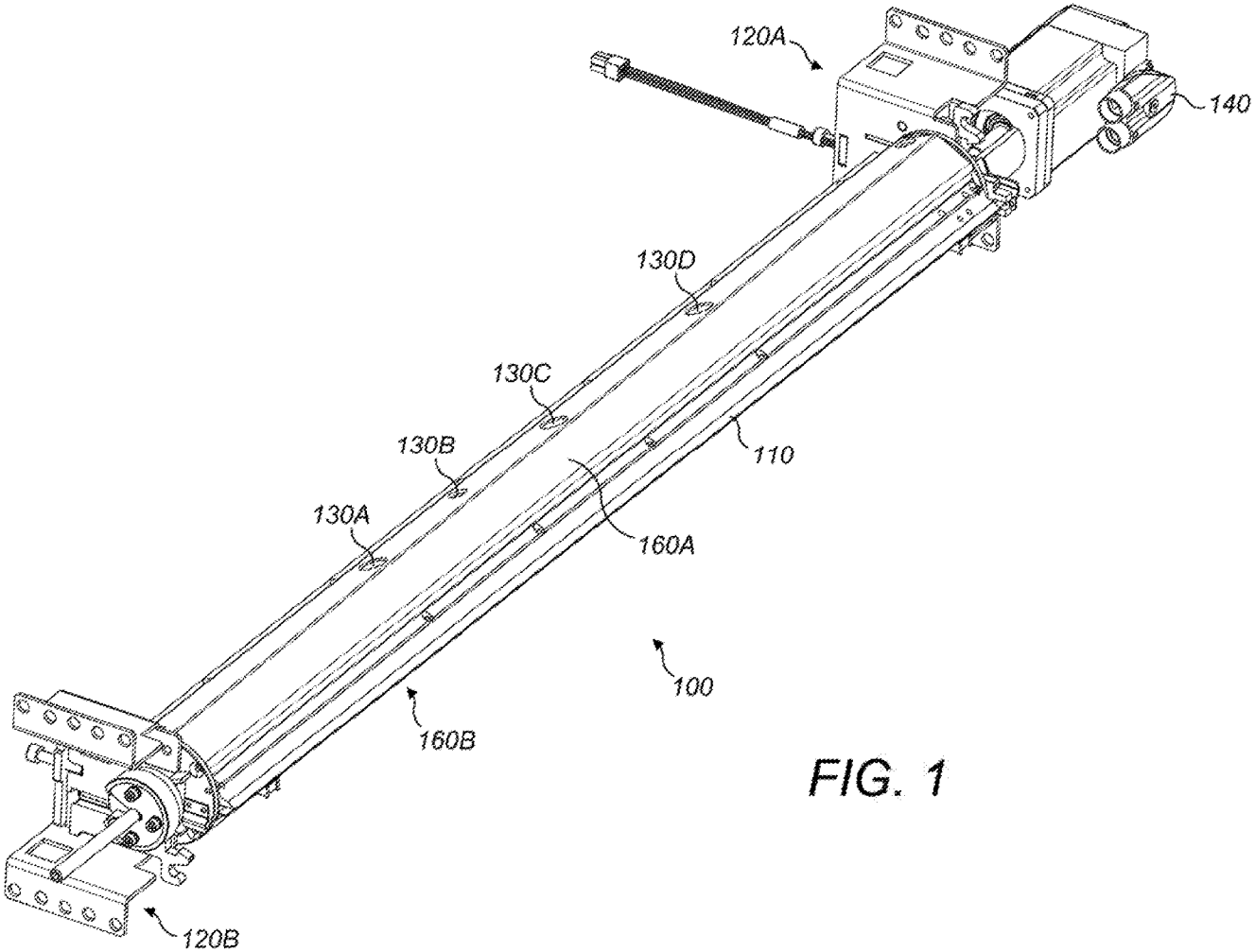
FIG. 1 is a schematic drawing showing a perspective view of a fluid chamber according to an example.

FIG. 1 shows a perspective view of an apparatus 100 according to an example. The apparatus 100 comprises a chamber 110. In FIG. 1, the chamber 110 is closed and comprises a housing with an upper housing portion 160A and a lower housing portion 160B. In use the chamber 110 is formed between the upper housing portion 160A and the lower housing portion 160B. The chamber 110 is arranged to receive a fluid. This fluid may comprise a priming fluid or substrate coating, e.g. a fluid suitable for application in a printing process. It may comprise a fluid for pre or post treatment of an item, e.g. a primer or varnish. In certain cases the fluid is a liquid. In FIG. 1, a plurality of fluid supply nozzles 130 are provided in the upper housing portion 160A. In other cases one or more fluid supply nozzles may be provided in one or more of the upper and lower housing portions 160. The fluid supply nozzles 130 may be spaced to allow uniform filing of the chamber with the fluid. An additional air evacuation aperture may also be provided for clogged air evaluation. In certain cases a low pressure or vacuum may be applied to the air evacuation aperture to aid air outflow from the chamber and uniform fluid filing. Application of a low pressure or vacuum can also enable full filling of the chamber volume without fluid dripping from an aperture of the chamber.

The chamber 110 of FIG. 1 extends along an axis and is mounted between a first mounting bracket 120A and a second mounting bracket 1208. The two mounting brackets 120 form a mounting that sets the position of the chamber 110 within a printing system. In one implementation, the chamber 110 may extend across a width of a media transport system within the printing system. In the example of FIG. 1, the first mounting bracket 120A is further arranged to support a motor. The use of the motor will be described later below.

In one implementation, the internal chamber surfaces, e.g. the internal surfaces of the upper and lower housing portions 160 might be coated with hydrophobic coating to avoid fluid blockages and/or fluid build-up that may occur during long operational periods. In one example, the interior configuration of the upper and lower housing portions may be symmetrical. This can enable easy assembly, e.g. of the internal components described below.

Figure 2:
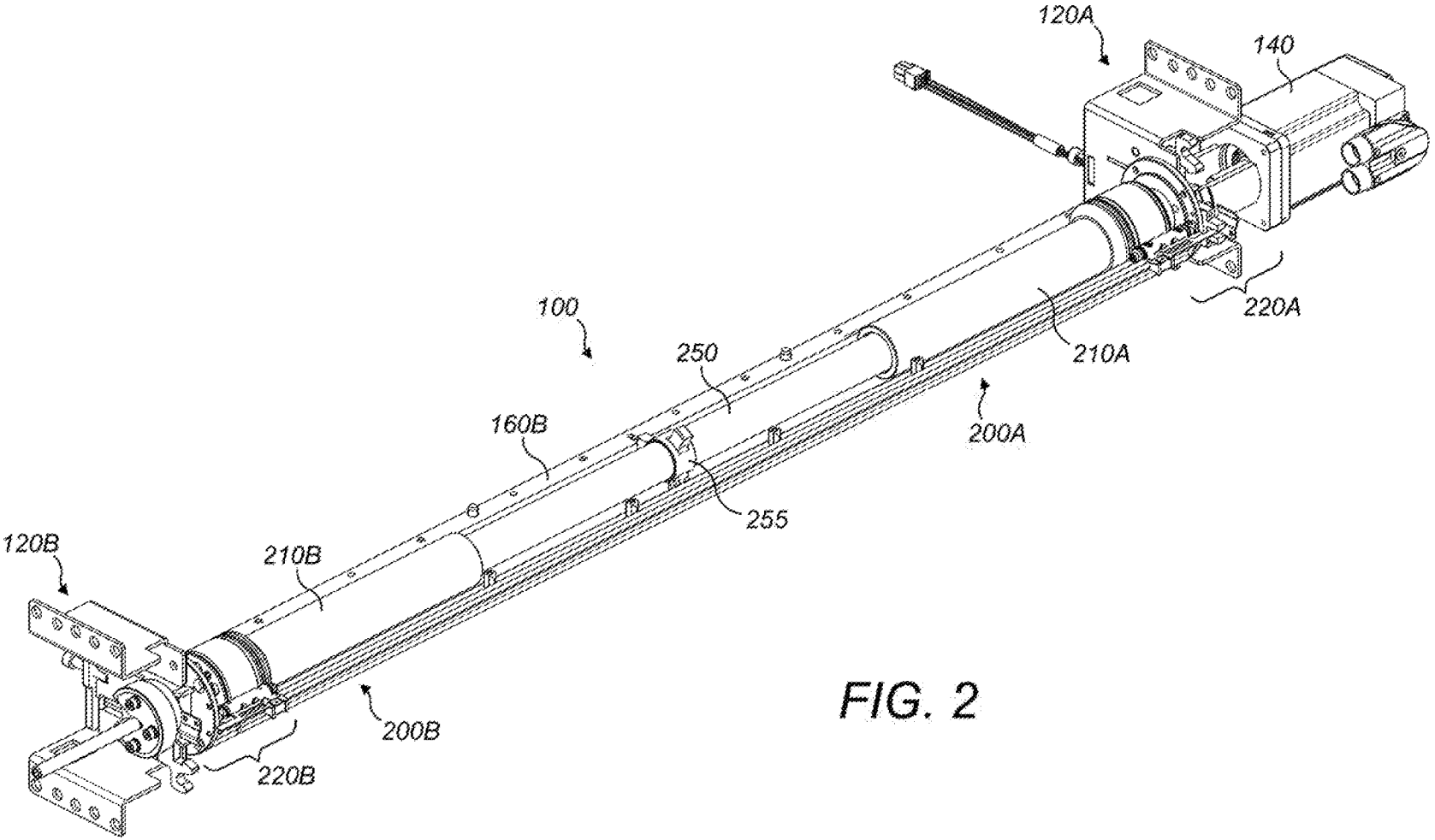
FIG. 2 is a schematic drawing showing a perspective view of an interior of the fluid chamber of FIG. 1 according to an example.

FIG. 2 shows the apparatus 100 of FIG. 1 with the upper housing portion 160A removed. This shows the interior of the chamber 110. The lateral ends of the chamber 110 are defined by two lateral end seals 220. A first lateral end seal 220A seals the interior of the chamber 110 at a first end and a second lateral end seal 220B seals the interior of the chamber 110 at a second end. In the example of FIG. 2 the lateral end seals 220 are coupled along the axis of the chamber 110 by a connecting part 250. The connecting part 250 may comprise a single portion or a number of distinct portions and extends along the length of the chamber 110 along the axis. In FIG. 2, the shown portions of the connecting part 250 comprise two protecting sleeves 210 and a central co-axial sleeve 270. Each protecting sleeve 210 may be telescopic, e.g. the diameter of the sleeve may vary as the sleeve extends from a location of a lateral end seal to the center of the chamber 110. As is described in more detail with reference to FIG. 3, in the present example the connecting part 250 allows a rotational movement to be translated from the motor 140 at a location of one lateral end seal to a location of the other lateral end seal. In the example of FIG. 2, a centering clamp 255 is provided at a substantially central location along the length of the chamber 255. The centering clamp 255 supports the connecting part 250, i.e. provides a bush or support part that at one or more locations is coupled to, or rests on, the housing of the chamber 110 and that in the center supports the connecting part 250. Although only a single centering clamp 255 is shown in FIG. 2, in other examples a plurality of clamps may be provided and/or these may be provided at different points along the length of the chamber 110. The precise configuration may depend on a geometry and a configuration of the printing system.

Figure 3:
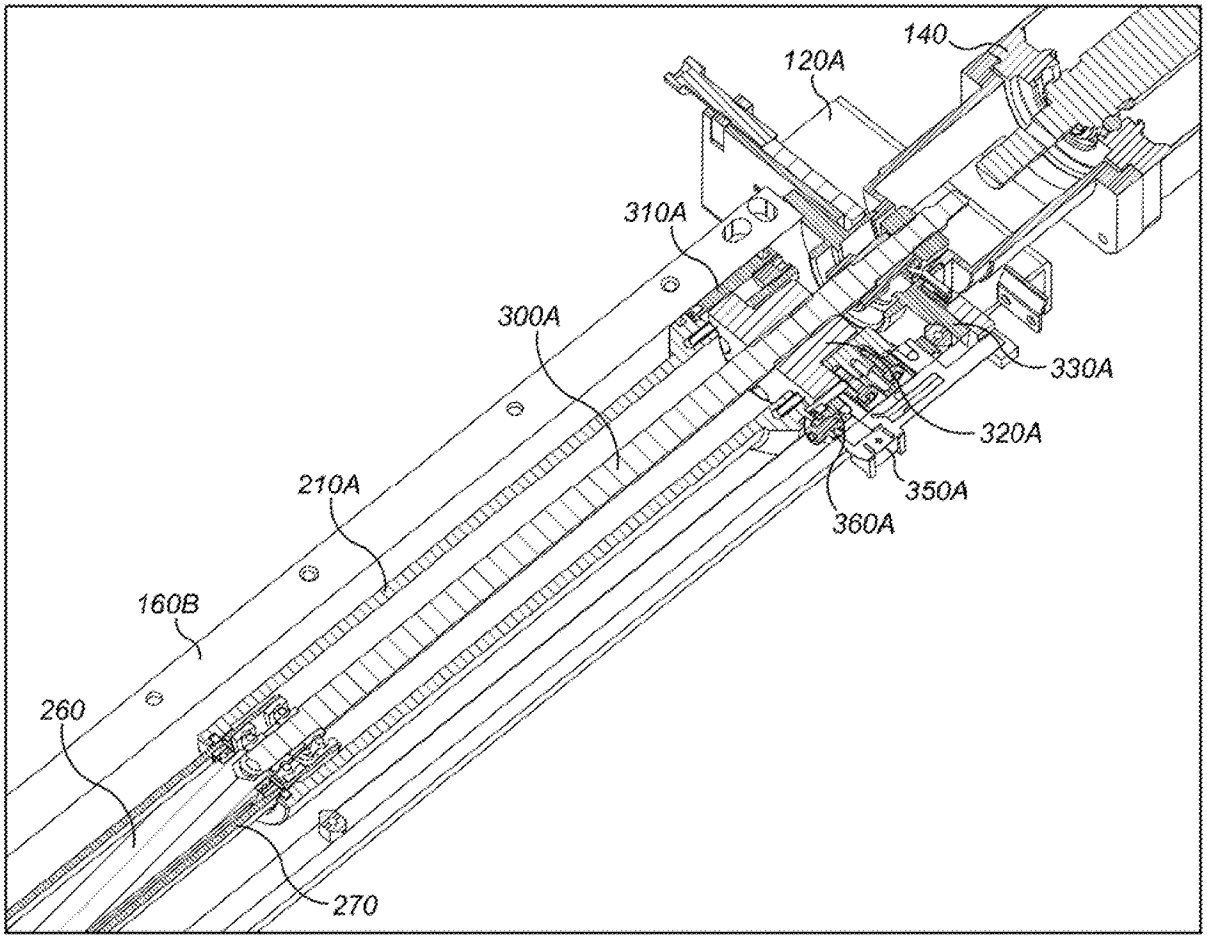
FIG. 3 is a schematic drawing showing a perspective view of a cross-section along an axis of the fluid chamber of FIG. 1 according to an example.

FIG. 3 shows a cross-section of the chamber 110 at one end of the apparatus 100. The cross-section is taken along a horizontal plane that contains the axis of the chamber 110. This plane may represent a join between the upper and lower housing portions 160 of the housing. As seen in FIG. 3, lateral end seal 220A forms part of a linear actuator. The linear actuator is arranged to move the lateral end seal 220A along the axis of the chamber 110, e.g. towards the center of the chamber 110 and/or towards the mounting bracket 120A. The linear actuator may be implemented in a variety of manners. In the example of FIG. 3, the linear actuator comprises a floating nut 320A that is mounted upon a lead screw 300A. The linear actuator is driven by motor 140. In the present case, an axle of the motor 140 is coupled to the lead screw 300A such that rotation of the axle of the motor 140 rotates the lead screw 300A. The threads of the lead screw 300A and the floating nut 320A are configured such that rotation of the lead screw 300A is translated into linear movement of the floating nut 320A within the chamber 110. In the present example, the floating nut 320A forms part of the lateral end seal 220A. In one case, the floating nut 320A may comprise a piston seal ring such that a fluid in the chamber 110 cannot pass beyond the lateral end seal 220A. In certain implementations each lateral end seal 220A may comprise a plurality of components that act to seal a lateral end of the chamber; this may differ from those illustrated in the Figures depending on requirements and printing system configuration. In another example, the linear actuator may be implemented using an air pressure piston with an appropriately configured stroke length.

Returning to FIG. 3, it can be seen that protecting sleeve 210A acts to seal the lead screw 300A from the interior volume of the chamber 110, such that fluid within the chamber does not interact with the components of the linear actuator. In FIG. 3, an annular sensor plate 330A is arranged between the chamber 110 and the mounting bracket 120A. The annular sensor plate 330A may, for example, comprise a magnetic sensor that detects a proximity of floating nut 320A and/or a contact sensor that detects contact between a component of the floating nut 320A and the sensor plate. The annular sensor plate 330A enables configuration of the lateral end seals, for example they may be used during an initial set-up to determine when each end seal is at a "home" location that can be used as a reference for future motion. In FIG. 3, the lead screw passes through an aperture in the annular sensor plate 330A and an aperture in the mounting bracket 120A before being coupled to the axle of the motor 140 at one end. At the other end of the lead screw 300A, there is a coupling between the lead screw 320A and a connecting rod 260. In this example, the connecting rod 260 extends between the end of the first lead screw 300A and an end of a second lead screw 300B that forms part of a linear actuator for the second lateral end seal 220B. The connecting rod is rotatably coupled to each lead screw 300 such that rotation of the axle of the motor 140 rotates both lead screws 300 and drives each linear actuator.

The configuration of the second lateral seal 220B is similar to that of the first lateral end seal 220A, albeit with symmetrical mapping about the center of the chamber 110. The threads of the second lead screw 300B and the second floating nut 320B are such that rotation of the axle of the motor 140 causes symmetrical motion of each lateral end seal. For example, rotation of the axle of the motor 140 in a first direction may move both floating nuts 320 towards the center of the chamber 110 while rotation of the axle of the motor in a second direction may move both floating nuts 320 towards respective mounting brackets 120. As can be seen, this means that rotation of the lead screws 300 in one direction, e.g. via the connecting rod 260, causes opposing linear motion of the floating nuts 300, as configured via respective threading configurations. In other examples, each linear actuator may be implemented separately; for example, the second lateral end seal 220A may be driven by a separate, independent motor or other alternative drive mechanism. In a similar manner to the protecting sleeves 210, the co-axial sleeve 270 surrounds the connecting rod 260 and seals the drive mechanism from fluid within the chamber 110.

The example described above provides an implementation of an apparatus with one or more adjustable end seals. Although in the described example, two adjustable end seals are used, in an alternate case only a single end seal need be adjustable. Having one or more adjustable end seals allows the inner volume of a chamber to be adjusted. A linear actuator is used to move each end seal. In the described example, the linear actuator comprises a piston arrangement with a floating nut and a lead screw. In other examples, a different linear actuator mechanisms may be used, including hydraulic pistons, rack and pinion systems and/or resilient members. In a case where the chamber 110 comprises an aperture, wherein each end of the aperture is defined by a lateral end seal, this adjustable volume may be used to provide an adjustable fluid application zone. Although an adjustable chamber has utility beyond fluid application, certain additional examples relating to fluid application are described below.

In an example as shown in FIG. 3, lateral end seal 220A further comprises a format limiter 350A and an auxiliary piston 360A. The format limiter 350A is a component that provides a boundary to an aperture formed between the upper and lower housing portions 160. This is shown more clearly in FIG. 4.

Figure 4:
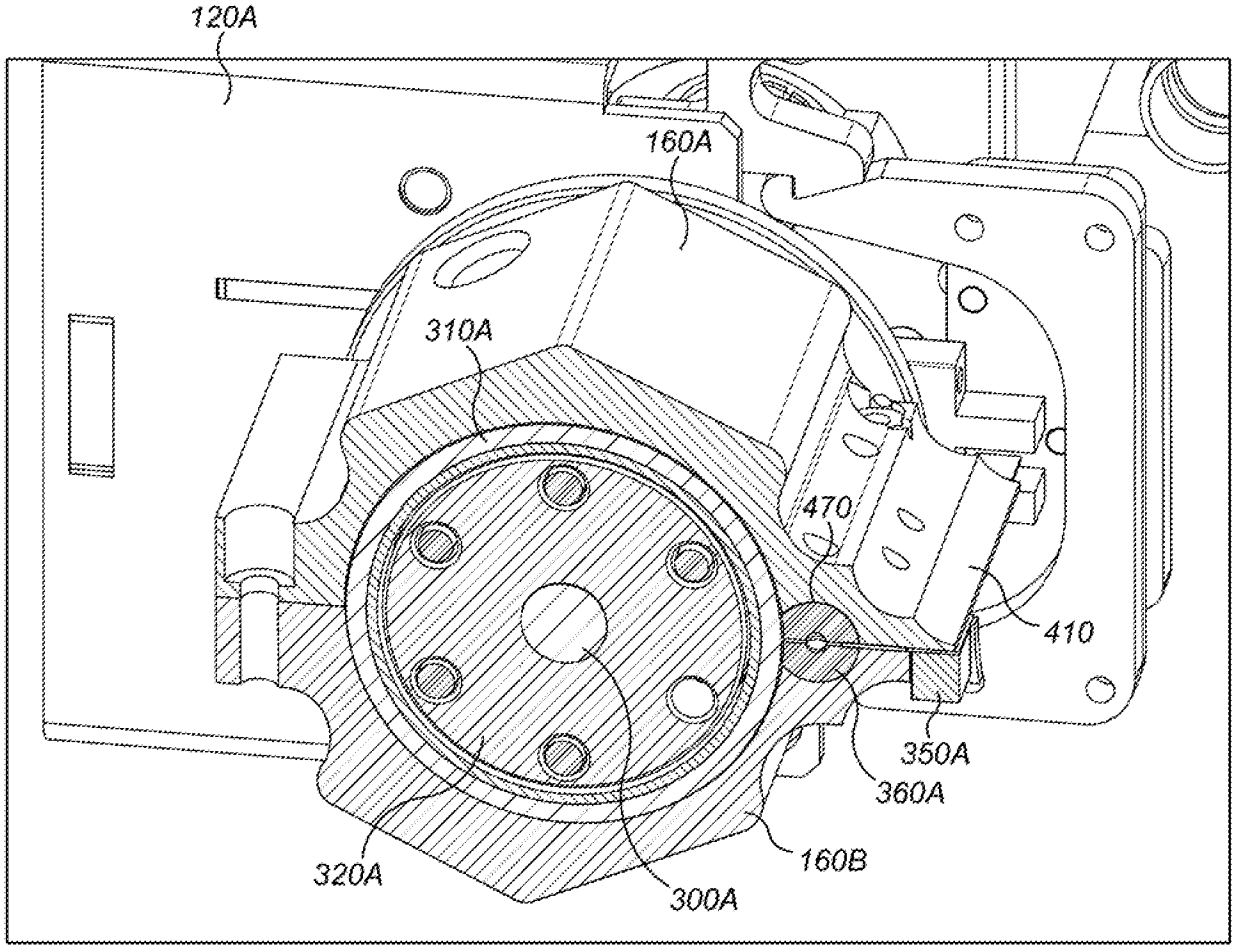
FIG. 4 is a schematic drawing showing a perspective view of a cross-section perpendicular to the axis of the fluid chamber of FIG. 1 according to an example.

FIG. 4 shows another cross section of the chamber 110. This cross section is taken through a vertical plane that is perpendicular to the axis of the chamber 110. The cross-section is taken through a vertical plane that is coincident with the floating nut 320A. The floating nut 320A is visible in place on lead screw 300A. Piston seal 310A extends from the floating nut 320A to the interior of the housing. In FIG. 4, the upper housing portion 160A and the lower housing portion 160B are visible. In the present example, the upper housing portion 160A comprises a lip or projection 450 that extends from the chamber along the plane formed between the two housing portions, i.e. this projection extends over a corresponding area of the lower housing portion 160B. In this case, the format limiter 350A is located below the projection 450. In FIG. 4, the auxiliary piston 360A is located within a volume 470 formed between the two housing portions. In the present example, the volume is cylindrical and at each end of the chamber 110 the volume contains a respective auxiliary piston 360.

Returning to FIG. 3, the auxiliary piston 360A is coupled to the floating nut 320A such that movement of the floating nut 320A along the axis of the chamber results in a corresponding movement of the auxiliary piston 360A within the volume 470. A similar arrangement applies for the other lateral end seal 220B. In the present example the auxiliary piston 360A has at least three functions. In other examples one or more of these functions may be provided by one or more differing components. A first function is supporting linear motion of lateral end seal 220A. In particular, as the auxiliary piston 360A is coupled to the floating nut 320A yet is restrained by the geometry of the chamber such that it moves within volume 470, rotation of the floating nut 320A can be reduced and/or avoided. This helps ensure efficiency of movement and minimizes rotational wear of the piston seal 310A. A second function is supporting and enabling movement of the format limiter 350A, i.e. movement additional to the movement of floating nut 320A due to the linear actuator mechanism. The auxiliary piston is able to take rotating movement arising from friction in the floating nut 320A and thus reduce and/or avoid mechanical forces acting on thin components the format limiter 350A. A third function is to improve sliding conditions and avoid torque load on the components of the format limiter 350A. For example, as the format limiter 350A is coupled to the auxiliary piston 360A and the auxiliary piston 360A has its own piston seal and piston ring, components of the format limiter 350A can move freely within an aperture formed between the two housing portions. In this case movement of the format limiter 350A has minimal friction and occurs in a loadless manner.

Figure 5:
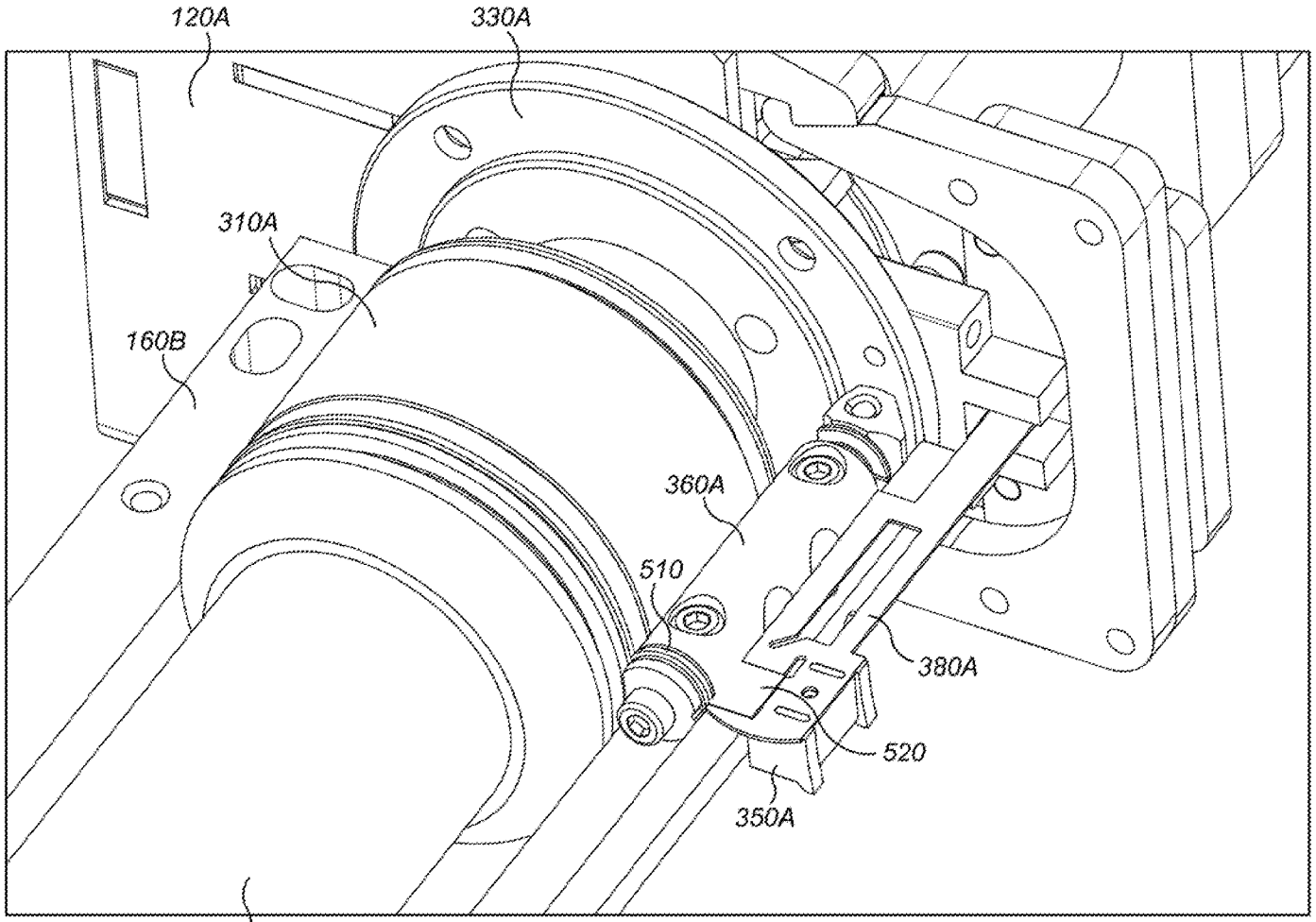
FIG. 5 is a schematic drawing showing a close-up view of a lateral end seal according to an example.

Certain example components of the format limiter 350A are shown in FIG. 5. FIG. 5 shows a perspective view of one end of the apparatus 100 without the upper housing portion 160A. In FIG. 5 the annular sensor plate 330A is visible between the mounting bracket 120A and the end of the lower housing portion 160B. The piston seal 310A exterior to the floating nut 320A is also visible, followed by an additional chamber seal 510 that ensures liquid does not penetrate beyond the edge of the floating nut 320A within the chamber. The protective sleeve 210A is then shown beyond the additional chamber seal 510. Although in this example the lateral end seal 220A comprises three seal components: a portion of protective sleeve 210A, additional chamber seal 510 and piston seal 310A, alternative examples may use one or more differing components to seal the lateral end of the chamber 110 and prevent fluid from the interior of the chamber penetrating into a drive mechanism for the linear actuator.

Moving to the auxiliary piston 360A this is shown secured to the floating nut 320A. A piston seal 520 for chamber volume 470 is also shown. This piston seal 520 may be substantially co-incident with chamber seal 510. An aperture in the chamber is then defined between the upper edge of the lower housing portion 160B and the lower edge of the upper housing portion 160A. This aperture is sealed at lateral ends of the chamber 110 by a flat seal 370A that forms part of the format limiter 350A. Hence, a width of the aperture of the chamber 110 is set by varying the position of each lateral end seal along the axis of the chamber. In certain examples, this may be performed with a flat seal that is directly coupled to the floating nut 320A. In the example of FIG. 5, the flat seal 370A is coupled to the auxiliary piston 360A via a flag body 380A that forms part of the format limiter 350A. The flat seal 370A avoids liquid penetration from the chamber 110 to a location upstream of the aperture edge, e.g. by capillary action. In the example of FIG. 5, the auxiliary piston 360A is fixed, i.e. is used as a static cylinder that is coupled to the floating nut 320A.

Figure 6:
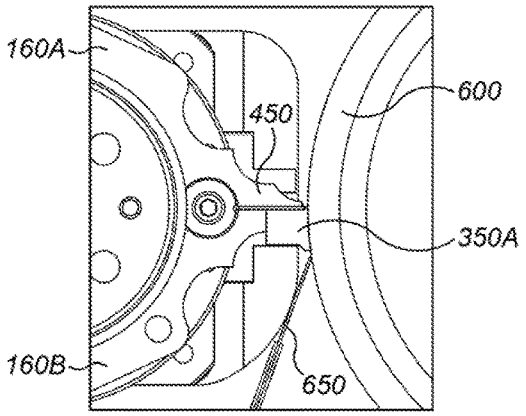
FIG. 6 is a schematic drawing showing a perspective view of a cross section of the fluid chamber of FIG. 1 in use with a transfer member according to an example.
Figure 7:
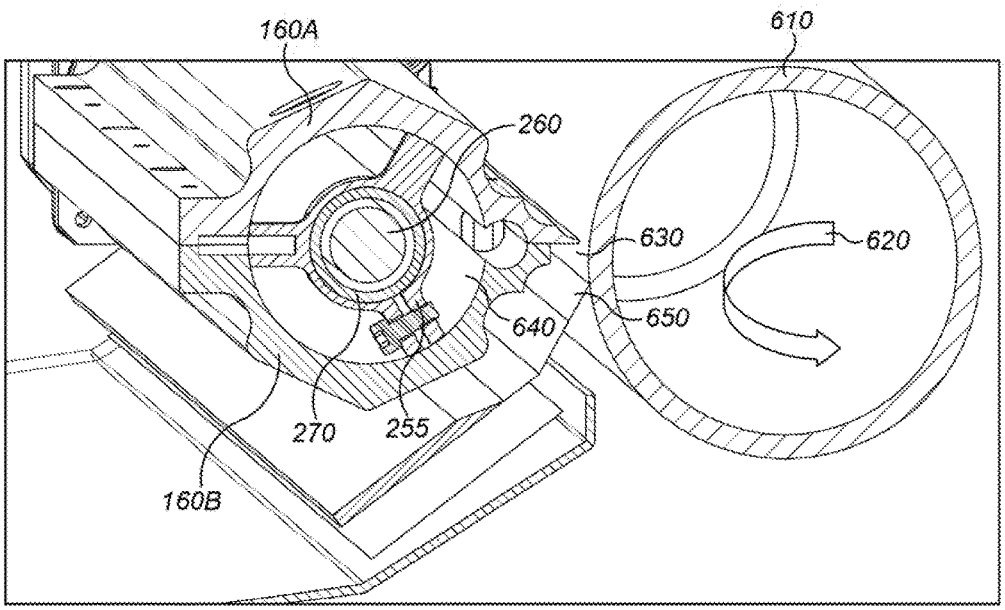
FIG. 7 is a schematic drawing showing a perpendicular cross section of the fluid chamber of FIG. 1 in use with a transfer member according to an example.

FIGS. 6 and 7 show the apparatus 100 in situ in a printing system. FIG. 6 is a perspective cross-section through a plane perpendicular to the elongate axis of the chamber 110. FIG. 7 is a two-dimensional cross-section of the same configuration.

In a general case, the printing system comprises a transfer member that acts to transfer fluid from the chamber 110 to a print medium or substrate. There may be one or more transfer members, e.g. a plurality of transfer members may be used to complete the transfer of fluid from the chamber to the substrate. In other cases there may be no transfer member, e.g. the fluid may be applied directly to a substrate via the previously described variable width chamber. In any case, transfer of the fluid within the chamber 110 to a substrate occurs. In one example, the fluid may comprise a primer, i.e. a priming solution, or a treatment liquid to be applied to the substrate before the deposit of ink. In the example of FIG. 6, the transfer member comprises an anilox roller 610, e.g. a cylinder upon a surface of which fluid is deposited, the fluid then being transferred to a substrate by way of rotation of the cylinder. In one case this is achieved using a further application roller (not shown) that receives fluid from the anilox roller 610 and applies it to the application roller. The anilox roller 610 provides desirable metering of a fluid onto a substrate. In FIG. 6 there is an anticlockwise rotation of the anilox roller 610 as indicated by arrow 620. In other examples, the transfer member may comprise a non-cylindrical member and/or belt mechanism.

As is shown in FIGS. 6 and 7, the mounting brackets 120, which form a mounting, are arranged to position the chamber in relation to the anilox roller 610 such that the aperture of the chamber 110 is a defined distance from a surface of the transfer member. In one implementation, the bodies of the format limiters 350 are closest to the anilox roller 610; for example, an edge of each format limiter 350 may be spaced between 0.1 to 0.3 mm from the surface of the anilox roller 610. Despite this gap, the shape of each format limiter 350 and/or the use of a Teflon® construction prevents fluid from the chamber from extending beyond the lateral edges of each format limiter 350. In effect the lateral edges of each format limiter 350 constrain fluid flow and act to define the aperture of the chamber 110. This results in fluid being deposited on the anilox roller 610 with a width equal to the width defined by the lateral end seals 220; in particular examples by a combination of the seals around the floating nuts 300 and the format limiters 350. Hence, the adjustable width of the chamber 110 allows fluid to be deposited onto areas of the anilox roller surface with varying widths. In turn, this allows efficient transfer of fluid to print media and substrates of various formats and/or sizes. For example, fluid as deposited onto the surface of the anilox roller 610 with a particular area width is transferrable from the surface to a substrate following the rotation of the anilox roller 610, e.g. the substrate may be driven by a media transport to a location tangential to the anilox roller 610 where transfer can occur.

As can be seen from the example of FIG. 6, certain apparatus with a variable curtain width uses a drive mechanism embedded between two halves of an extruded chamber body to provide synchronized lateral movement of pistons along the axis of the chamber. Each piston forms part of, or is coupled to, an, arrangement of specially designed seals to avoid fluid escaping from a defined "fluid zone". By moving the pistons inwards and outwards within the chamber, i.e. towards the center of the chamber and back, fluid can be applied to areas with varying widths. This effective generates a closed chamber with a variable width aperture or slit.

In certain implementations, aperture size is matched to fluid speed and anilox linear speed, i.e. the linear speed of the tangential surface of the anilox roller. In one case, the apparatus is configured such that fluid velocity in the gap between upper and lower housing portions is at least twice the value of the anilox linear velocity. In one implementation the gap between upper and lower housing portions is 0.4 mm, but it could be a number of different sizes depending on the dimensions of the apparatus and/or the printing system.

As is indicated in FIG. 6 due to the design of the chamber 110 there is a low pressure fluid zone 630 beyond the aperture in the chamber. Within the chamber 110 there is a high pressure fluid zone, e.g. due to the supply of fluid under pressure to the fixed volume of the chamber and/or the inward movement of the lateral end seals 220. As can be seen in FIG. 6, the projection 450 of the upper housing portion 160A extends towards the surface of the anilox roller 610 and forms an upper edge of the low pressure fluid zone 630. As can be seen in FIG. 7, the projection 450 does not contact the surface if the anilox roller 610 in this example.

In one example, fluid is supplied to the supply nozzles 130 during use. In this case the majority of the pressure drop in the apparatus is across the aperture region. This allows laminar fluid flow from the aperture. In a test case the pressure change may be within a range of 0.005 to 0.080 (bar). In this test case, exit velocities may be in a range of 0.1 to 1.1 m/s, depending on applied pressure change. In this test case the aperture height is 470 μm, wherein changing the aperture height affects the velocity of fluid flow from the aperture, for example decreasing the height increasing fluid velocity and increasing the height lowers fluid velocity. In these test cases there was little change in fluid velocity along the length of the aperture and streamlines of fluid flow within the aperture were substantially parallel, indicating uniform fluid flow.

Below the projection 450 of the upper housing portion 160A is a doctor blade 650. A doctor blade is typically a thin elongate member that substantially extends along the length of the anilox roller 610. It has the function of diverting fluid excesses away from the anilox roller 610. Typically, an area of a doctor blade is in communication with a fluid tank such that excess fluid can be removed and possibly reused within the printing system. In the example of FIGS. 6 and 7, the doctor blade 650 is located below the projection 450 and forms a lower boundary to the low pressure liquid zone 630. As the doctor blade 650 is located below the format limiters 350, as can be seen in FIG. 7, there is no format spreading, e.g. due to the configuration of the apparatus a curtain of fluid maintains its width as it descends from the aperture under pressure and/or gravity forces to the doctor blade tip.

Turning to FIG. 7, it can be seen that, in one example, there is a thin aperture or slit between the upper and lower housing portions. This aperture extends from the interior of the chamber 110, via the volume 470 for the movement of the auxiliary pistons 360. In the present example, it is defined at its lateral ends by flat seal 370A. The body portion of format limiter 350A also forms a fluid boundary such that fluid is applied to the anilox roller 610 within the bounds set by the format limiters 350. The doctor blade 650 is also visible below the format limiter 350A. In certain examples, the upper housing portion 160A and the lower housing portion 160B are formed from symmetrical halves. In this case, a projection portion of the lower housing portion 160B, corresponding to projection 650, may be cut to accommodate lateral movement of the format limiters 450. This can be seen in FIG. 7. Removal of a projection portion of the lower housing portion 160A may also help avoid fluid dripping over the tray formed by the doctor blade 650 below. In the example of FIG. 7, the system utilizes gravitation forces to draw out a curtain of fluid between the aperture and the doctor blade.

In the example of FIG. 7, the format limiters 350 do not contact the surface of the anilox roller 610, i.e. as described above there is a defined spacing between the apparatus 100 and the transfer member. As the apparatus 100 is fixed in place via the mounting brackets 120 and is contactless, this enables tangential movement of the anilox roller 610, e.g. upward and downward from the perspective of FIG. 7. This can be achieved without affecting any fluid "beading" areas where fluid passes from the chamber 110 to the surface of the anilox roller 610.

In one implementation, the anilox roller 610 may transfer fluid deposited on the surface thereon to a rubber application roller. In this case, the contactless arrangement may allow the anilox roller 610 to be disconnected from the application roller by way of a tangential movement, e.g. upwards or downwards. For example, the anilox roller 610 may be mounted on a pivoted arm that is moveable via a further linear actuator such as a pneumatic or hydraulic piston. This movement may then allow fluid transfer to the application roller to stop. This can control format length, e.g. the length of a cut substrate. Hence, in this case, control of print media with varying heights and widths is achievable. This allows fluid application off-roll, e.g. to a variety of cut substrates. For example, to prevent fluid from being applied to a substrate beyond the end of a cut length the anilox roller 610 may be displaced vertically in FIG. 7, such that at a subsequent time coincident with the end of the substrate passing the application roller, fluid would no longer pass to the application roller and thus the substrate. Control of anilox roller engage/disengage timing may be performed by computer so as to match substrate length. Such control can be configured based on one or more of the geometry, timings and inertia ratio of the moving parts of the printing system.

In a variation of the above case, the anilox roller may have two working and one service position. In a first, main, working position the anilox roller is in a contact with an application roller and transfers a certain fluid volume to the application roller. The apparatus is located by adjustment screws tangentially to the anilox roller in manner such that the anilox roller is able to freely move upward. The format limiters may have a shape corresponding to the curve of the anilox roller in order to avoid a significant gap where fluid could escape. In a second, semi-engaged, working position, the anilox roller moves upward a certain distance. This stops fluid transfer to an application roller. Finally, in a service position, the anilox roller lifts up a further distance and allows system cleaning and maintenance.

In contactless cases, the lateral movement of the anilox roller when moved upwards is negligible, e.g. less than 0.1 mm with an arm length, e.g. a roller width, of 200 mm. In these cases, the doctor blade may be configured to be flexible enough to be engaged in both working anilox roller positions discussed above. To aid this the doctor blade may be initially adjusted with a preload of 0.2 mm. The anilox roller can also be a light-weight roller.

A number of examples and variations are described above. It shown be noted that certain described features may be extracted from the described examples and used independently to achieve an effect in a printing system. More-over, omission, replacement and addition of features is envisaged. This may occur depending on particular factors of implementation.

In certain described examples, fluid format control is achieved, enabling control of fluid application to substrates that vary in width and/or length. Certain examples similarly provide one or more efficient design features that enable fluid format control in a minimal time period and/or with minimal operator intervention. Certain examples and/or features described herein may reduce downtime in a printing system such as a printing press, reduce fluid contamination of surrounding areas and/or simplify maintenance. For example, the lack of contact with the anilox roller can reduce maintenance by avoiding significant wear.

In a comparative case a closed chamber may be used. In these cases the chamber is of a fixed width that is dependent on the printing system, e.g. an anilox roller width. However, as the fluid within the chamber is under pressure side seals are required. These side seals are made of special materials that withstand high pressures over prolonged time periods. As such the side seals are fixed in place. In a comparative case these side seals contact an anilox roller. In this comparative case movement of the side seals is not possible due to initial pressure contact between anilox and the seals.

In comparison, according to certain described examples contactless lateral end seals are used. These may be Teflon®. These seals are arranged to move laterally using linear actuators and in certain cases also enable a transfer member to move tangentially. In certain described examples there is a high fluid pressure inside a chamber and inside a slit in the chamber. This high pressure rapidly drops once a jet of fluid leaves a narrow slit area. The fluid is constrained only by an upper housing portion, which may be half of a pair, and left and right movable seal members (e.g. format limiters). Excessive fluid applied to the anilox roller may be targeted back to a fluid tank by a doctor blade. In certain cases only one doctor blade is required, again simplifying design and maintenance. As such fluid width control may be achieved using a closed-chamber slit apparatus, which is able to supply fluid to a rotating roller by "bead" contact.

In certain examples, movable pistons form part of lateral end seals that are driven by a drive mechanism. This drive mechanism may comprise motorized left and right lead screws and floating nuts arranged inside each piston. In certain variations, each main piston is connected to a smaller diameter ail piston, which slides inside an appropriately-shaped section of the chamber.

Certain examples described herein are useful for sheet fed delivery techniques that requires, for example, liquid or primer application inside a substrate format. Substrate format could be any paper size in a given range; for example, in one case the apparatus may support a variable format width from 410 mm to 760 mm and a variable format length from 297 mm up to 535 mm. This is particularly useful for thin substrates, wherein an over wetting of substrate edges by a fluid can cause paper deformation with many upstream delivery problems. It is also useful for short print runs where it is useful to change primer application area with substrate format (e.g. width and length, i.e. values in a process dimension and a lateral dimension).

Certain examples described herein relate to apparatus and methods. In a method case, certain techniques described above may be applied, either using the described apparatus or another apparatus. For example, a method for configuring a printing system may comprise, for a pressurized chamber arranged in relation to a transfer member, the pressurized chamber being positioned a predetermined distance from a surface of the transfer member, adjusting a size of an aperture of the pressurized chamber by varying the position of at least one lateral seal of the pressurized chamber, wherein, in use, a fluid supplied to the pressurized chamber is applied to the surface of the transfer member from the aperture of the pressurized chamber.

The preceding description has been presented only to illustrate and describe examples of the principles described. In certain Figures similar sets of reference numerals have been used to ease comparison of similar and/or comparative features. Variations are described herein, in places as features of examples. For example, the apparatus may be extended to a duplex system, the auxiliary piston may be replaced with an alternate component to provide a stabilizing effect, any of the seals described herein including the piston and/or flat seals may be constructed from Teflon® or a material with analogous properties. In a duplex system an arrangement comprising apparatus 100, anilox roller 610 and an application roller may be mirrored, with a first arrangement mounted above a media transport path and a second arrangement mounted below the media transport path, each arrangement being configured to apply a fluid to a respective side of a substrate. In certain cases at least one of the lateral seals comprises a format limiter arranged laterally in relation to the aperture and a mounting is arranged to position the format limiter a defined distance from the surface of the transfer member such that the transfer member may be moved tangentially without contacting the format limiter. The term print medium or substrate may refer to a discrete medium, e.g. a page of paper or material, or a continuous medium, e.g. a roll of paper or vinyl. This description is not intended to be exhaustive or to limit these principles to any precise form disclosed. Many modifications and variations are possible in light of the above teaching.

What is claimed is:

1. Apparatus for applying a fluid to a transfer member in a printing system comprising:

a pressurized chamber arranged to receive the fluid, the chamber comprising a housing, an aperture and a pair of lateral seals, the aperture being defined between the pair of lateral seals, a mounting arranged to position the chamber in relation to the transfer member such that the aperture is a defined distance from a surface of the transfer member, wherein at least one of the lateral seals is moveable along an axis of the pressurized chamber to adjust a size of the aperture.

2. Apparatus according to claim 1, wherein at least one of the lateral seals forms part of a seal linear actuator arranged to move the at least one lateral seal along an axis of the pressurized chamber.

3. Apparatus according to claim 2, wherein the seal linear actuator comprises a lead screw coupled to a motor and a floating nut moveable along the axis of the pressurized chamber.

4. Apparatus according to claim 1, wherein the pair of lateral seals are coupled by a connecting rod that extends along at least a portion of the pressurized chamber.

5. Apparatus according to claim 1, comprising:

a doctor blade spaced from the pressurized chamber in a direction of movement of the surface of the transfer member.

6. Apparatus according to claim 1, wherein the defined distance is between 0.1 to 0.3 mm.

7. Apparatus according to claim 1 wherein the transfer member comprises an anilox roller.

8. Apparatus according to claim 1, wherein at least one of the lateral seals comprises a format limiter arranged laterally in relation to the aperture and the mounting is arranged to position the format limiter a defined distance from the surface of the transfer member.

9. Apparatus according to claim 8, comprising:

a format-limiter linear actuator arranged to move the format limiter laterally within the aperture.

10. Apparatus according to claim 8, wherein:

the housing comprises an upper portion and a lower portion, the upper portion comprises a projection that extends from the pressurized chamber towards the transfer member, and the format limiter is arranged below the projection.

11. The apparatus of claim 10, further comprising an auxiliary piston located within a volume formed between the upper and lower housing portions which supports linear motion of at least one lateral seal and enables movement of the format limiter.

12. The apparatus of claim 1, further comprising an annular sensor plate arranged between the chamber and the mounting that detects a distance of at least one of the lateral seals from the mounting.

13. The apparatus of claim 12, wherein the annular sensor plate enables the configuration of the end seals of the laterally-arranged linear actuators and determines when each end seal is at an initial location or home position as a reference for future motion.

14. A printing system comprising:

apparatus for applying a fluid to a transfer member, the apparatus comprising:

an elongate chamber arranged to receive the fluid, the chamber extending along an axis, and a pair of laterally-arranged linear actuators, each linear actuator comprising:

a lead screw; and an end seal for the elongate chamber that is moveable along the axis, the end seal comprising a floating nut coupled to the lead screw;

wherein rotation of at least one of the lead screws by a motor moves each floating nut along the axis within the elongate chamber.

15. The printing system of claim 14, wherein:

the elongate chamber comprises an upper housing portion and a lower housing portion, each end seal being arranged to seal the lateral ends of the elongate chamber between the upper housing portion and the lower housing portion.

16. The printing system of claim 14, wherein the lead screws are coupled by a connecting rod within the elongate chamber.

17. The system of claim 14, wherein the floating nut further comprises a piston seal ring such that a fluid in the elongate chamber cannot pass beyond the end seal.

18. A method for configuring a printing system comprising:

for a pressurized chamber arranged in relation to a transfer member, the pressurized chamber being positioned a predetermined distance from a surface of the transfer member, adjusting a size of an aperture of the pressurized chamber by varying the position of at least one lateral seal of the pressurized chamber, wherein, in use, a fluid supplied to the pressurized chamber is applied to the surface of the transfer member from the aperture of the pressurized chamber.

19. The method of claim 18, wherein:

the fluid supplied to the pressurized chamber has a fluid velocity;

the transfer member is an anilox roller that operates at a linear speed; and the size of the aperture is adjusted to match the fluid velocity and the anilox linear speed.

20. The method of claim 18, wherein:

the pressurized chamber comprises:

an upper and a lower housing portions;

a gap that allows for fluid flow located between the upper and lower housing portions; and the fluid supplied to the pressurized chamber has a fluid velocity;

the transfer member is an anilox roller that operates at a linear speed; and wherein the fluid velocity in the gap is at least twice the linear velocity of the anilox roller.

* * * * *